US005884442A

United States Patent [19]

Breault

[11] Patent Number: 5,884,442

[45] Date of Patent: Mar. 23, 1999

[54] COMPOSITE JOIST AND CONCRETE PANEL ASSEMBLY

[75] Inventor: Andre Breault, Orange Park, Fla.

[73] Assignee: Structural Systems Ltd., Providenciales, Turks/Caicos Islands

[21] Appl. No.: 829,475

[22] Filed: Mar. 28, 1997

[51] Int. Cl.[6] ..... E04C 3/294; E04B 5/02; E04B 9/04

[52] U.S. Cl. ..... 52/245; 52/414; 52/223.6; 52/745.19; 52/742.14; 52/319; 52/630; 52/602; 52/639; 52/649.1; 249/189; 425/470; 264/259; 264/333

[58] Field of Search ..... 249/18, 189, 192; 264/259, 333, 273, 274, 275; 52/414, 245, 223.6, 742.14, 745.19, 639, 319, 650.1, 630, 649.1, 602, 644; 425/470

[56] References Cited

U.S. PATENT DOCUMENTS

| | | | |
|---|---|---|---|
| 2,297,952 | 10/1942 | Friberg . | |
| 4,036,921 | 7/1977 | Ellen | 52/223.6 X |
| 4,416,099 | 11/1983 | Fiergolla et al. | 52/319 |
| 4,586,307 | 5/1986 | Fiergolla et al. | 52/602 X |
| 4,742,985 | 5/1988 | Mathis . | |
| 5,131,201 | 7/1992 | Larson et al. | 52/249 X |
| 5,235,791 | 8/1993 | Yaguchi | 52/414 X |
| 5,448,866 | 9/1995 | Saito et al. | 52/414 |
| 5,501,055 | 3/1996 | Storch et al. . | |

*Primary Examiner*—Robert Canfield
*Attorney, Agent, or Firm*—Thomas C. Saitta

[57] ABSTRACT

A method of producing a cambered composite joist and concrete panel assembly, and the assembly so produced, comprising the steps of providing a negatively cambered casting mold, positioning at least one negatively cambered composite joist with a bottom chord joined to a web member having non-attached top apices into the mold such that the top apices rest within the mold, pouring concrete into the mold and allowing it to harden to form a cambered concrete panel with the joists extending from the panel, removing the assembly from the mold and inverting it such that the precast camber in the panel flattens out from the effects of the weight of the panel and creep during final curing.

17 Claims, 3 Drawing Sheets

COMPOSITE JOIST AND CONCRETE PANEL ASSEMBLY

BACKGROUND OF THE INVENTION

This invention relates generally to prefabricated concrete floor or roof panels with embedded composite steel joists or trusses and methods for making same. More particularly, the invention relates to such assemblies where the embedded joists consist of a bottom chord and a zig-zag web member, the web member being embedded directly in the concrete. Even more particularly, the invention relates to such assemblies where the concrete is cast into a cambered mold with the joist correspondingly cambered, such that when the concrete panel has hardened, is removed from the mold and inverted, the weight of the panel together with the creep of the concrete during final curing will diminish or eliminate the camber to produce a generally flat roof or floor member.

Concrete floors or roofs are commonly used in building construction, the floors or roofs being poured on site on forms built onto joists or trusses. This is a relatively slow and labor intensive method of constructing these floors and roofs. Concepts of modular construction can be utilized in the construction of concrete floors or roofs, the floors or roofs being formed of precast concrete panel and composite joist assemblies which are set into place in the building and joined together to create a unified floor or roof. Previous efforts at manufacturing these precast assemblies have encountered numerous problems, most of which stem from the fact that the known methods utilize flat molds which produce flat concrete panels with joists connected to one side of the panel. Because the panels have significant weight and due to the shrinkage of the concrete during final curing, they will flex in the center when installed so that the floor or roof has a negative camber rather than being flat or planar.

It is an object of this invention to provide a method of producing a precast concrete panel and composite joist assembly which can be used to create floors, roofs or the like, the method being an improvement over known precast techniques with regard to economy of time and money, as well as in producing a superior assembly. It is a further object to provide such a method which results in precast concrete panel and composite joist assembly which has a residual positive camber to counter the weight and curing creep effects inherent in the panel. It is a further object to provide such a method which utilizes a casting table or mold having a camber, as well as joists having corresponding cambers, where the mold can be used to form multiple panels simultaneously.

SUMMARY OF THE INVENTION

A casting table or mold having a curved bottom with negative camber, two opposing end walls and two opposing side walls defining a generally thin, rectangular form to receive poured concrete or similar material for curing is provided, the casting mold being of any desired length but preferably from about 110 to 160 feet with a width of about 8 feet. Preferably the curve or camber of the casting table is a portion of a circle, and most preferably the camber is a portion of a 1600 foot radius circle. It is also preferred that the side walls angle outward, and most preferably at an angle of about 116 degrees from the bottom. The transverse end walls may be positioned at any point along the longitudinal length of the casting table to produce a panel of desired length, and plural panels can be cast at one time. Wire mesh reinforcement is placed into the mold and then cambered composite joists corresponding in curvature to the camber of the casting table are positioned longitudinally within the casting mold, the joists comprising a bottom chord and a zig-zag web member, the ends of the joists comprising seat members, equal in height to the end and side walls, which rest on the mold bottom and position the apices of the web member approximately midway in depth within the mold. At least two lifting lugs comprising lateral support legs extending outwardly from the top chord to the mold bottom with a horizontal joining member are supplied to provide attachment means to remove and handle the completed panel after hardening and to help maintain the joists in the upright position in the mold during the pouring of the concrete. A longitudinal reinforcing member may be welded longitudinally to the horizontal joining members between the two lifting lugs, to the web members and to the seat members to provide reinforcement during removal. Preferably, steel weld plates having inwardly extending anchor members are fastened to the side walls of the casting mold. Concrete of suitable consistency is then poured into the cambered mold and smoothed even with the tops of the end and side walls. In this manner the concrete panel will encase the seat members, the weld plates and anchors, the horizontal joining members, the ends of the lifting lug legs and the apices of the web members. After hardening, the concrete panel is lifted and inverted so that the joists and bottom chord depend beneath the concrete panel. The panel can then be transported and set into place to form a part of a building floor or roof. Because the side walls are angled, the side walls of laterally abutting panels will combine to form a V-shaped groove with the weld plates exposed in the side walls. A panel joining member, such as a length of rebar, is then placed into the groove and welded to the weld plates to join the two lateral panels. The groove is then filled with concrete to further secure the two panels. Because the concrete panels were cast with a camber, the weight of the panel when inverted will reduce or remove the precast camber, producing a generally planar panel.

DETAILED DESCRIPTION OF THE INVENTION

With reference now to the drawings, the invention will now be described in detail with regard for the best mode and the preferred embodiment. The invention is a method of making a precast, cambered concrete panel and composite joist assembly, and the assembly so produced.

Figure 1:
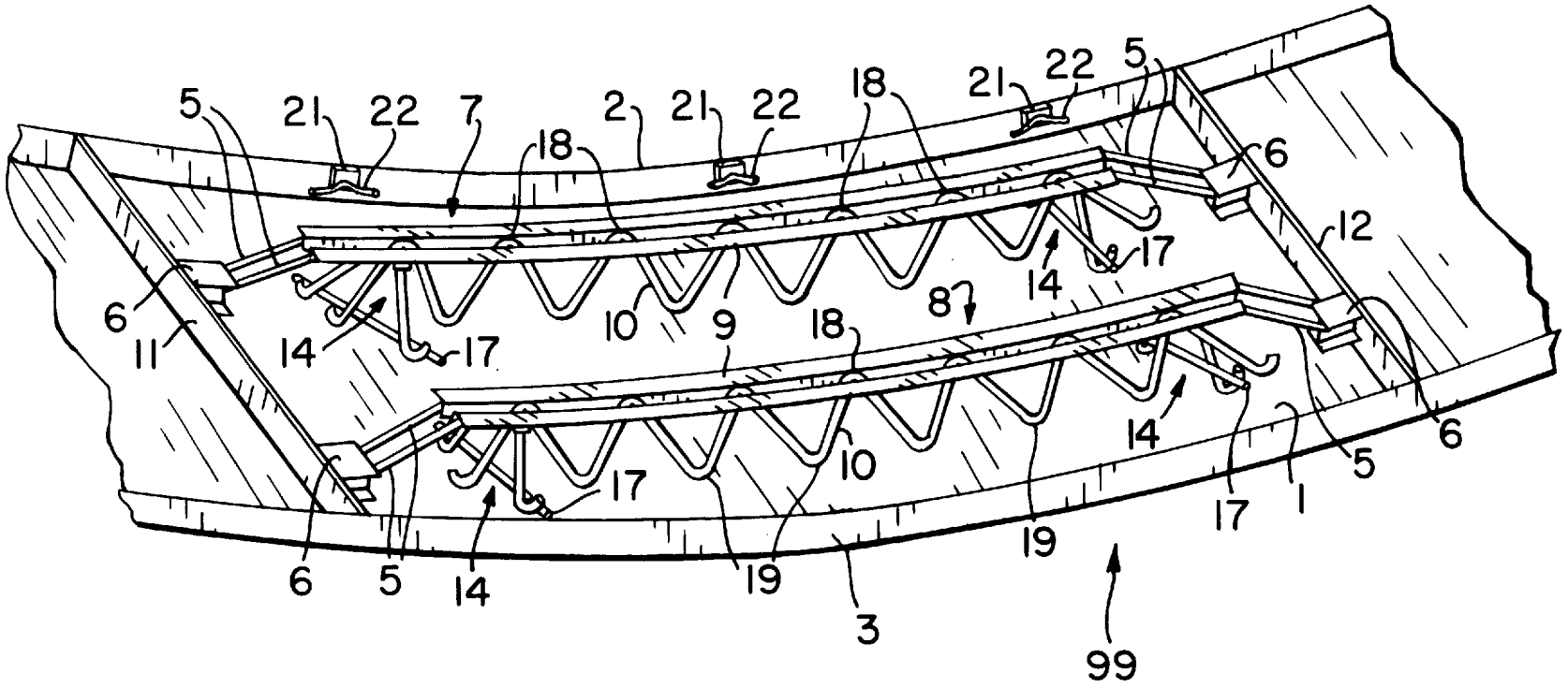
FIG. 1 is perspective view of the casting mold, showing the joists and other members in position prior to pouring the concrete.

As shown in FIG. 1, the invention comprises in general providing a generally large casting table or mold 99 where the casting area for a concrete panel member 13 is defined by a bottom 1, two parallel opposing side walls 2 and 3 approximately three inches in height which extend the longitudinal length of casting table 99, and two or more opposing end walls 11 and 12 approximately three inches in height extending laterally between the side walls 2 and 3. End walls 11 and 12 may be fixed or movable within mold 99, thereby allowing the length of the concrete panel member 13 to be varied as desired. Additional end walls 11 or 12 may be set into the mold 99 to allow for simultaneous casting of multiple concrete panel members 13, all of which will have the identical camber. The casting table may have any suitable dimensions to form the desired size concrete panel member 13, but preferably the casting table 99 has sufficient length to allow casting of relatively large panel members 13 or multiple panel members 13. A useful length is between about 110 to 160 feet, with a width of approximately 8 feet, which is well suited to simultaneously produce panel members 13 having lengths from 20 to 30 feet. The casting table 99 is negatively cambered in the longitudinal direction, in that the bottom 1 and side walls 2 and 3 are cambered or curved upward toward their ends. Preferably the mold 99 has a camber consisting of a portion of the circumference of a circle, and most preferably is a circumferential portion of a circle having a radius of approximately 1600 feet. This arc produces the desired camber in the precast concrete panel members 13 of typical length for building construction.

It is preferred that the side walls 2 and 3 be angled out beyond perpendicular from the bottom 1, and most preferable that they be angled outward at approximately 116 degrees. End walls 11 and 12 are preferably perpendicular to bottom 1, but may also be angled if desired. The various components of casting table 99 are preferably made of steel or other metal, and may be sprayed or coated with suitable release agents as is well known in the art to allow for easy separation of the concrete panel member 13 from the mold 99.

After the casting mold 99 has been properly sized by placement of the end walls 11 and 12, reinforcing mesh 4 or other suitable reinforcing members are placed into the mold 99, using plastic or metal chairs or the like to raise the reinforcing mesh 4 a short distance above the bottom 1 so as to be positioned internally within the poured concrete panel 13, as is well known in the industry. At least one but usually two, and possibly more, longitudinally extended composite joist members 7 and 8 are then placed into mold 99 longitudinally and in parallel. The joists 7 and 8 extend essentially the full longitudinal length from end wall 11 to end wall 12 and each comprises a bottom chord 9, formed by one or preferably a pair of angle irons, steel bars, rebar or like members, welded or otherwise permanently attached to the bottom apices 18 of a web member 10 of zig-zag, sinusoidal or other recurring pattern, formed of steel bar or the like from ½ inch to 1 inch in diameter. The ends of each joist 7 and 8 comprise seat members 6 joined to bottom chord 9 by seat connecting members 5. Joists 7 and 8 are supported at the desired height above bottom 1 by seat members 6, the seat members 6 resting directly on the bottom 1 of mold 99. Seat members 6 each preferably comprises a short segment of an I-beam, with seat connecting members 5 being segments of rebar or the like which can be welded to seat members 6 and bottom chord 9. The joist members 7 and 8 are cambered or curved in corresponding amount to the casting table 99. In this manner each of the top apices 19 of web members 10 will all be positioned the same distance above bottom 1, preferably such that the lowest edge of each top apex 19 is positioned approximately 1.5 inches above the mold bottom 1 so as to be located midway in the concrete panel 13.

Because seat members 6 are relatively narrow in the lateral direction, it is preferred that each joist 7 and 8 be provided with at least a pair of lifting lug rocker members 14. The lifting lug rocker members 14 provide additional lateral stability to maintain the joists 7 and 8 in proper position and alignment when the concrete is poured, as well as providing the attachment means which allow the hardened concrete panel member 13 to be lifted from the mold 99 and inverted for storage or use. The lifting lug rocker members 14 preferably comprise a pair of leg members 15, composed of rebar or similar material, which extend outward and downward from a joining plate 26 affixed by welding or other means to the bottom chord 13, leg ends 20 resting on mold bottom 1. A lateral joining member 17, also composed of rebar or the like, is permanently attached by welding or other suitable means to the leg members 15 adjacent the leg ends 20. For reinforcement during handling, a longitudinally extending reinforcing member 16 may be connected by welding or other suitable means to opposing seat members 6, lateral joining members 17 of lifting lug rocker members 14 and to the top apices 19 of each web member 10.

Figure 4:
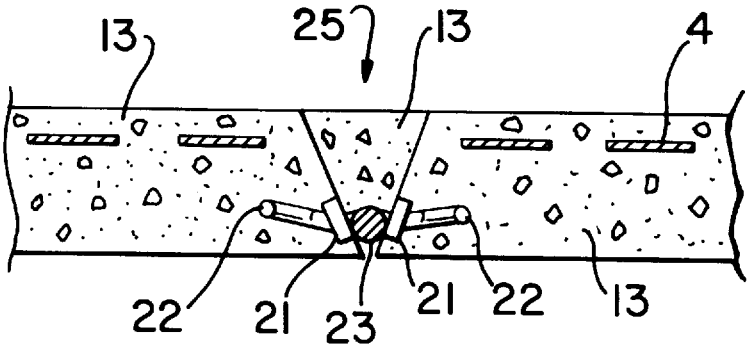
FIG. 4 is a lateral view showing the manner of joining two laterally abutting concrete panels, the panels shown in cross-section to expose the weld plates.

Metal weld plates 21 having anchor members 22 are positioned at various points on the side walls 2 and 3 such that the weld plates 21 abut in parallel manner the side walls 2 and 3 and anchor members 22 extend into the body of the mold 99, as shown in FIGS. 1 and 4. Weld plates 21 are preferably shorter than the side walls 2 and 3 and are mounted toward or adjacent the tops of the side walls 2 and 3 by C-clamps, wires, or other support means.

Figure 2:
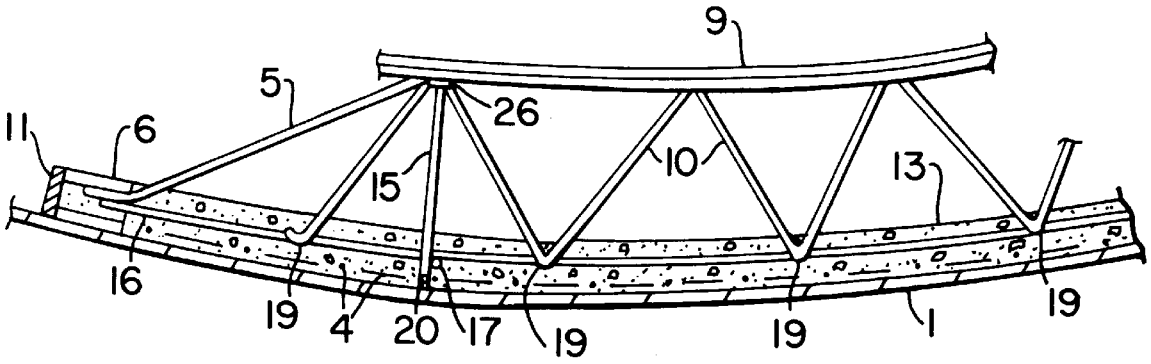
FIG. 2 is a side view of a portion of one of the joists as embedded in the concrete, with the concrete panel member shown in longitudinal cross-section to expose the other components.
Figure 3:
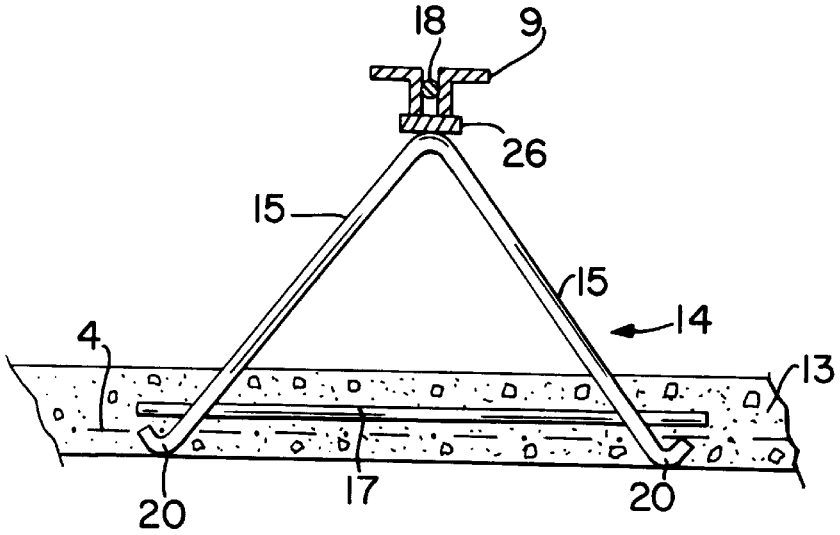
FIG. 3 is an end view showing the lifting lug member exposed, with the concrete panel member shown in lateral cross-section.

As shown in FIGS. 2, 3 and 4, concrete is now poured into mold 99 in proper quantity to fill the mold 99 to the tops of the side walls 2 and 3 and end walls 11 and 12. The formulation of the concrete must be such that the concrete can be smoothed into the cambered mold 99 and will harden without flowing or slumping to a level position. Concrete mixtures of suitable formulation and relatively short cure times are known in the art. When the concrete has been poured, the top apices 19 of web members 10, the leg ends 20 and lateral joining members 17 of lifting lug rocker members 14, the reinforcing mesh 4, the seat members 6 and the ends of the seat member connecting members 5, and the weld plates 21 and anchor members 22 will be embedded within the concrete panel member 13. The weld plates 21 will be exposed along the lateral edge of the concrete panel member 13 and the seat members 6 will be exposed on the top and bottom of the concrete panel member 13. The web members 10 and the leg members 15 of lifting lug rocker members 14 will extend from the exposed side of the concrete panel member 13.

After the concrete has hardened, the concrete panel 13 assembly is removed from the mold 99 by attaching cables from winches or cranes to the exposed legs 15 of the lifting lug rocker members 14. The panel member 13 is raised upward and inverted or rotated 180 degrees such that the joists 7 and 8 are now below the concrete panel member 13. The panel 13 can be stored, transported or installed into a building as a floor or roof component. The combination of concrete panel 13 and each joist 7 and 8 is the structural equivalent of a composite T-beam. No top chord is required for joists 7 and 8 since the concrete panel 13 itself acts to join the top apices 19. The camber which was precast into the concrete panel 13 due to the use of a cambered mold 99 and cambered joists 7 and 8 compensates for the weight of the concrete and subsequent creep during final curing, such that when inverted the concrete panel member 13 is flat or minutely cambered in the positive direction. When two panels 13 are abutted laterally, the edges formed by the angled side walls 2 and 3 of the mold 99 combine to form a V-shaped groove 25, as shown in FIG. 4. The weld plates 21 are paired such that a panel joining member 23, such as a length of rebar, may be positioned between the two and the three components welded together to join the panels 13 laterally. Concrete or other filler material is then poured into groove 25 to fill the gap and further connect the two panels 13.

It is contemplated that equivalents and substitutions of certain elements and components described above may be obvious to those skilled in the art. The true scope and definition of the invention therefore is to be as set forth in the following claims.

I claim:

1. A precast cambered composite joist and concrete panel assembly comprising a cambered concrete panel and at least one cambered joist attached to said concrete panel, said at least one cambered joist comprising a bottom chord member and a web member having top apices and bottom apices, where said bottom chord is joined to said bottom apices and said top apices are embedded within said cambered concrete panel.

2. The assembly of claim 1, where said at least one cambered joist further comprises lifting lug rocker members connected to said bottom chord member and partially embedded in said concrete panel member.

3. The assembly of claim 1, further comprising weld plates embedded in the sides of said concrete panel.

4. A composite joist and concrete panel assembly produced by the steps of:

(A) providing a casting mold defined by a bottom, two opposing side walls and two opposing end walls, where said casting mold is negatively cambered;

(B) providing a cambered joist member comprised of a bottom chord and a web member having top apices and bottom apices, where said bottom chord is joined to said bottom apices, and positioning said cambered joist member within said casting mold such that said top apices are located within said casting mold;

(C) pouring concrete into said mold to form a cambered concrete panel with said top apices embedded in said concrete panel, and (D) allowing said concrete panel to harden to form a precast concrete panel and composite joist assembly and removing said assembly from said casting mold.

5. The assembly of claim 4, where said step of providing said casting mold further comprises providing said casting mold is negatively cambered as a segment of the circumference of a circle.

6. The assembly of claim 5, where said step of providing said casting mold further comprises providing said casting mold as a segment of the circumference of a circle having a radius of approximately 1600 feet.

7. The assembly of claim 4, where said step of providing said casting mold further comprises providing end walls which are movable relative to said bottom.

8. The assembly of claim 4, where said step of positioning said cambered joist member within said mold further comprises positioning said top apices so as to be located midway within said casting mold.

9. The assembly of claim 4, where said step of providing said cambered joist member further comprises providing seat members attached to the ends of said cambered joist member, where said seat members are positioned on said bottom of said casting mold to position said cambered joist member.

10. The assembly of claim 4, where said step of providing said cambered joist member further comprises providing lifting lug rocker members attached to said cambered joist member, where said lifting lug rocker members have leg ends which are positioned on said bottom of said casting mold.

11. A method of forming a precast concrete panel and composite joist assembly comprising the steps of:

(A) providing a casting mold defined by a bottom, two opposing side walls and two opposing end walls, where said casting mold is negatively cambered;

(B) providing a cambered joist member comprised of a bottom chord and a web member having top apices and bottom apices, where said bottom chord is joined to said bottom apices, and positioning said cambered joist member within said casting mold such that said top apices are located within said casting mold;

(C) pouring concrete into said mold to form a cambered concrete panel with said top apices embedded in said concrete panel, and (D) allowing said concrete panel to harden to form a precast concrete panel and composite joist assembly and removing said assembly from said casting mold.

12. The method of claim 11, where said step of providing said casting mold further comprises providing said casting mold is negatively cambered as a segment of the circumference of a circle.

13. The method of claim 12, where said step of providing said casting mold further comprises providing said casting mold as a segment of the circumference of a circle having a radius of approximately 1600 feet.

14. The method of claim 11, where said step of providing said casting mold further comprises providing end walls which are movable relative to said bottom.

15. The method of claim 11, where said step of positioning said cambered joist member within said mold further comprises positioning said top apices so as to be located midway within said casting mold.

16. The method of claim 11, where said step of providing said cambered joist member further comprises providing seat members attached to the ends of said cambered joist member, where said seat members are positioned on said bottom of said casting mold to position said cambered joist member.

17. The method of claim 11, where said step of providing said cambered joist member further comprises providing lifting lug rocker members attached to said cambered joist member, where said lifting lug rocker members have leg ends which are positioned on said bottom of said casting mold.

* * * * *

Disclaimer 5,884,442—Andre Breault, Orange Park, Fla. COMPOSITE JOIST AND CONCRETE PANEL ASSEMBLY. Patent dated March 23, 1999. Disclaimer filed March 4, 2004, by the assignee, Structural Systems Ltd.

Hereby enter this disclaimer to claims 1-17 of said patent.

*(Official Gazette, June 15, 2004)*